United States Patent [19]

Dornbusch et al.

[11] 4,350,281

[45] Sep. 21, 1982

[54] ONE-PIECE SHIPPING CONTAINER WITH CUT-CASE PROTECTION

[75] Inventors: Arthur H. Dornbusch; Raymond D. Smith, both of Cincinnati, Ohio

[73] Assignee: The Procter & Gamble Company, Cincinnati, Ohio

[21] Appl. No.: 195,464

[22] Filed: Oct. 9, 1980

[51] Int. Cl.[3] ..... B65D 90/04

[52] U.S. Cl. ..... 229/38; 206/44 R; 206/602; 220/416

[58] Field of Search ..... 229/37 R, 37 E, 38; 206/44 R, 602; 220/416; 30/2

[56] References Cited

U.S. PATENT DOCUMENTS

| | | | |
|---|---|---|---|
| 1,960,947 | 5/1934 | Lauth et al. | 229/23 R |
| 2,171,309 | 8/1939 | Luce et al. | 229/6 |
| 2,524,441 | 10/1950 | Guyer | 229/43 |
| 2,572,123 | 10/1951 | Edtmiller | 229/38 |
| 2,598,123 | 5/1952 | Hollinshead | 229/16 |
| 2,637,484 | 5/1953 | Buttery | 229/34 |
| 2,823,794 | 2/1958 | Garman | 206/44 R |
| 2,827,162 | 3/1958 | Garman | 206/44 R |
| 2,835,431 | 5/1958 | Stone | 229/38 |
| 2,835,432 | 5/1958 | Wilmot | 229/39 |
| 2,858,059 | 10/1958 | Kitchell | 229/37 R |
| 3,055,569 | 9/1962 | Layne, Sr. | 229/16 |
| 3,114,494 | 12/1963 | Wasyluka | 229/37 |
| 3,269,638 | 8/1966 | Forbes | 229/16 |
| 3,355,081 | 11/1967 | Kachurchak | 229/14 |
| 3,522,906 | 8/1970 | Painter | 229/37 |
| 3,730,416 | 5/1973 | Pilz | 229/16 A |
| 4,116,330 | 9/1978 | Ellis | 206/44 R |

*Primary Examiner*—William Price
*Assistant Examiner*—Gary E. Elkins
*Attorney, Agent, or Firm*—John V. Gorman; Douglas C. Mohl; Richard C. Witte

[57] ABSTRACT

A unitary blank and a container formed from the blank that includes cut case protection in the form of full and partial inner wall elements. The container comprises a pair of end walls and a pair of side walls in alternating side-by-side relation. At least one of the end walls includes a top closure flap and both of the end walls include a bottom closure flap to form an outer section of a bottom closure. The side walls each have a side wall liner flap that is substantially the same dimension as the side wall and which is adapted to fold into face-to-face contact with the associated side wall, and bottom closure flap hingedly connected to the side wall at a first score line and adapted to form coplanar portions of an inner section of the bottom closure. The bottom closure flaps of the side wall each include a partial end wall liner flap hingedly connected at a second score line perpendicular to the first score line and adjacent to an end thereof. The partial end wall liner flaps are adapted to form coplanar portions of a partial liner for one of the end walls.

6 Claims, 14 Drawing Figures

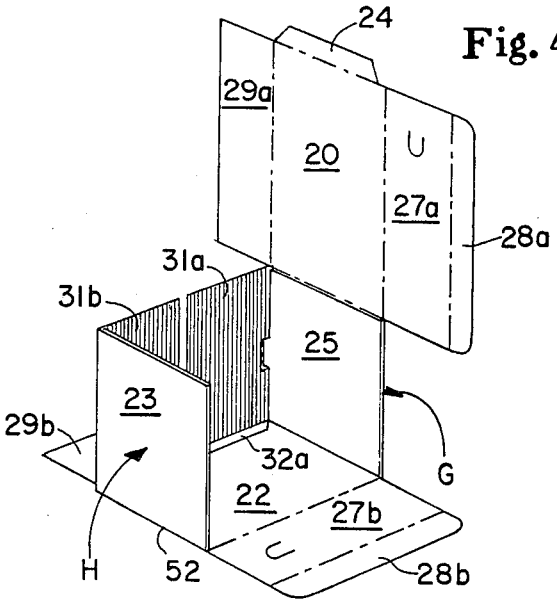
Fig. 4
Fig. 5
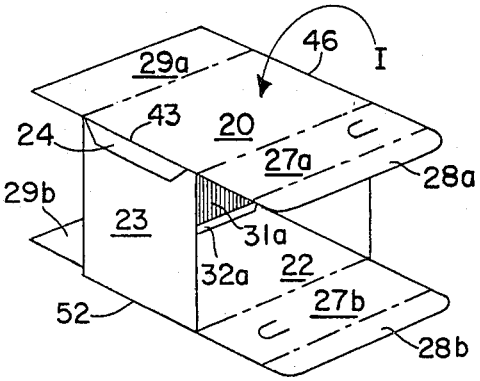
Fig. 6
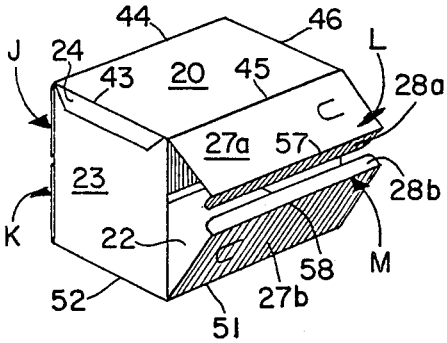

ONE-PIECE SHIPPING CONTAINER WITH CUT-CASE PROTECTION

TECHNICAL FIELD

This invention relates generally to containers formed of fiberboard or the like assembled from one-piece blanks and particularly to containers in which a double wall construction is provided to protect the items being shipped in the container from damage when the container is cut open for either display purposes or unloading.

BACKGROUND ART

After arriving at a destination shipping containers are frequently cut away to partially or completely faciliate unloading of the article so that they can be put in a display case or shelf for sale. The most common method for cutting open the container is with a knife or other sharp cutting tool. Unless a good deal of care is used the knife can very easily cut not only the shipping container but also cut or damage the articles contained therein. To protect the articles contained therein from this sort of damage relatively few techniques have been described in the prior art. For example, U.S. Pat. No. 3,355,081 issued to J. Kachurchak on Nov. 28, 1967 discloses a liner strip to be used in a cardboard box. The liner strip is composed of a high strength plastic capable of resisting cutting by a knife. The liner strip is placed along the inside walls and there is some method of indicating its position on the outside container walls.

Of course the knife can be specially designed so that the cutting blade length is equal to the container wall thickness or additional perimeter pads can be inserted along the inside of the container after assembly of the container. For one example, U.S. Pat. No. 2,315,094 issued to W. A. Rehfield et al. on Mar. 30, 1943 discloses a container in which partitions are inserted to separate each of the bottles. However, these techniques have obvious drawbacks. Trying to provide a knife with a specific length blade would require a plethora of different knives for the equally numerous shipping containers with varying wall thicknesses. In addition, closely packed articles such as cereal boxes could still be cut by the knife. And finally, the addition of perimeter pads to containers adds considerable cost to each container in the form of material costs, additional assembly time and slower production rates.

An alternate method for providing some protection against accidental cutting of the articles contained in a container is to assemble the container from a blank having additional panel elements that provide double walls. Examples of this approach include U.S. Pat. No. 3,114,494 issued to P. Wasyluka on Dec. 17, 1963 which discloses a container formed from a cut and scored blank that has two complete sets of bottom walls and side walls connected by a single dividing line such that one set of bottom and side walls folds onto the other set. One set of the walls includes top closure flaps hingedly connected to the side walls as well. U.S. Pat. No. 3,730,416 issued to W. M. Pilz, III on May 1, 1973 discloses a self-locking, double-wall container assembled from a one-piece blank. The assembly of the container from the blank is relatively complex in order to accomplish the objective of being self-locking.

The Wasyluka and Pilz containers were primarily directed to providing a specialized, structurally stronger container and not necessarily to providing cut case protection. The containers are therefore not very economical for general use. Therefore, none of these containers completely solves the problem of providing integral cut case protection in an economical container formed from a unitary blank on carton assembly equipment.

It is the primary purpose of the present invention to provide a sufficient amount of cut-case protection integral with an economical container formed from a unitary blank on container assembly equipment and to thereby eliminate the need for additional perimeter pads.

A further object of the invention is to provide a container having integral cut case protection that can be stacked to create a self-standing display after removal of sections of the shipping container.

A further object of the present invention is to provide a shipping container having integral cut case protection and in addition having an additional integral divider means in the bottom of the container for additional support and separation for fragile articles and for the protection of plastic articles to prevent abrasion or scratching.

DISCLOSURE OF THE INVENTION

Accordingly this invention provides a corrugated container formed from a unitary blank. The container comprises a pair of side walls and a pair of end walls integrally connected in alternating side-by-side relation. The end walls each have an integrally connected bottom closure flap adapted to form the outer coplanar section of a bottom closure and at least one of the end walls has an integrally connected top closure flap. The side walls each have an integrally connected side wall liner flap that is adapted to fold inwardly into face-to-face contact with the respective side wall and that is substantially the same dimension as the associated side wall, and each of the side walls has a bottom closure flap that is integrally connected by a first score line and that is adapted to form inner coplanar sections of the bottom closure. The bottom closure flaps of the side walls each have a partial end wall liner flap that is integrally connected by a second score line perpendicular to the first score line and adjacent to an end thereof. The partial end wall liner flaps are adapted to form coplanar sections of a partial inner end wall liner beginning at the lower edge of one of the end walls.

BRIEF DESCRIPTION OF THE DRAWINGS

Further objects and advantages of the invention will become apparent from the following description and claims and from the accompanying drawings wherein:

FIG. 4 is a perspective view of the blank of FIG. 1 with the side walls folded 90° to a vertical position;

FIG. 5 is a perspective view of the blank of FIG. 1 with the end wall folded 90° to a longitudinal position and with the glue flap folded 90° and adhered to the side wall;

FIG. 6 is a perspective view of the blank of FIG. 1 in which the end wall bottom closure flaps are folded 90° to complete the bottom of the carton and the end wall top closure flaps are folded to close the top of the carton;

DETAILED DESCRIPTION OF THE INVENTION

Figure 7:
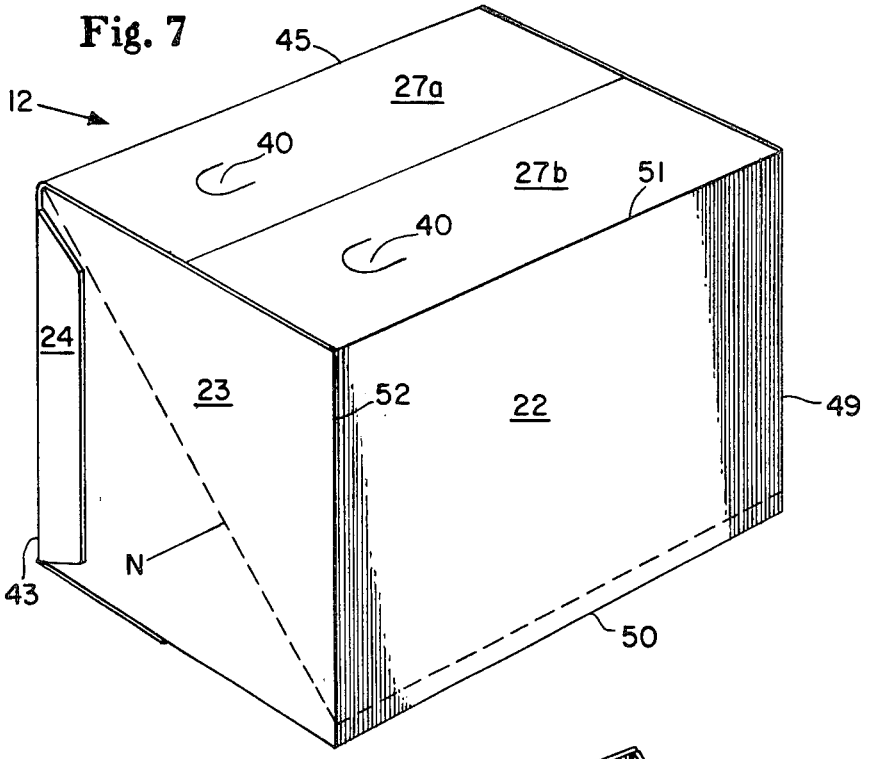
FIG. 7 is a perspective view of the container erected from the blank of FIG. 1.

Referring now to the drawings in detail, wherein like numerals indicate like elements throughout the several views, a container 12 of the present invention is shown in FIG. 7. The container 12 is erected from the blank 10 shown in FIG. 1. Blank 10 comprises a pair of end walls 20 and 22 and a pair of side walls 21 and 23 in alternating side by side relation and a glue flap 24. Parallel transverse score lines 43, 46, 49 and 52 separate the various walls and glue flap.

Each of the end walls 20 and 22 and the side walls 21 and 23 include left and right laterally extending closure flaps. The end walls 20 and 22 include top closure flaps 27*a* and 27*b* hingedly connected at score lines 45 and 51, respectively, and adapted to form coplanar sections of a top closure, and bottom closure flaps 29*a* and 29*b* hingedly connected at score lines 44 and 50, respectively, and adapted to form the outer coplanar sections of the bottom closure. Both of the top closure flaps 27*a* and 27*b* further include closure flanges 28*a* and 28*b* hingedly connected at score lines 57 and 58, respectively, and adapted to form a downwardly extending partition.

The side walls 21 and 23 include side wall liner flaps 25 and 26 hingedly connected at score lines 48 and 54, respectively, and adapted to fold into face-to-face contact with side walls 21 and 23. The side wall liner flaps 25 and 26 are substantially the same dimensions as the side walls 21 and 23, respectively, so that they will substantially cover the side walls 21 and 23 when the container 12 is erected. The side wall liner flaps 25 and 26 also include locking tabs 41*a* and 42*a*, respectively. The locking tabs are adapted to insert into mating die cut sections 41*b* and 42*b* on bottom closure flaps 31*a* and 31*b*, respectively, when the container 12 is being erected.

The side walls 21 and 23 also include bottom closure flaps 31*a* and 31*b* hingedly connected at score lines 47 and 53, respectively, and adapted to form the inner coplanar portions of the bottom closure. Each of the bottom closure flaps 31*a* and 31*b* further include a partial end wall liner flap 32*a* or 32*b* hingedly connected at score lines 55 and 56, respectively, which are perpendicular to score lines 47 and 53, respectively, and adjacent to an end thereof. The partial end wall liner flaps 32*a* and 32*b* are adapted to form coplanar sections of a partial end wall liner for end wall 22.

In order to provide as nearly continuous a partial end wall liner for end wall 22 as possible and yet still enable the container 12 to be erected from the blank 10 with ease, the bottom closure flaps 31*a* and 31*b* are sized in width (from the distal end to the hinge line with the associated side wall) to be only slightly less, approximately $\frac{1}{8}''$ to $\frac{1}{4}''$, than half the length of either of the end walls 20 and 22. Therefore the partial end wall liner flaps 32*a* and 32*b* are each also slightly less, approximately $\frac{1}{8}''$ to $\frac{1}{4}''$, in length than half the length of end wall 22. In a preferred embodiment the partial end wall liner flaps 32*a* and 32*b* also include chamfered edges, 34 and 35 on partial end wall liner flap 32*a* and 36 and 37 on partial end wall liner flap 32*b*, to further facilitate erecting the container 12. The partial end wall liner flaps 32*a* and 32*b* that form the partial end wall liner can vary in width (from the distal end to the hinge line with the associated bottom closure flap) depending on the protection required but, in the blank as shown in FIG. 2, the width should remain within the range of $\frac{1}{2}''$ and $1\frac{1}{2}''$. Otherwise, bottom closure flap 29*b*, which is reduced in length as the widths of partial end wall liner flaps 32*a* and 32*b* increase, may become functionally inadequate. If a wider partial end wall liner is desired, the blank 10 can be modified by eliminating bottom closure flap 29*b* and by increasing the width of bottom closure flap 29*a* to the length of the side walls 21 or 23. It should also be noted that a partial end wall liner can be formed by designing the blank 10 to have the partial end wall liner flaps 32*a* and 32*b* hingedly connected to the opposite edges of the bottom closure flaps 31*a* and 31*b* to which they are connected in the view of FIG. 1. This would provide a partial end wall liner for end wall 20. Again, as in the previous alternative, the width of the partial end wall liner flaps 32*a* and 32*b* could vary but should stay in the range of $\frac{1}{2}''$ and $1\frac{1}{2}''$. Otherwise, the bottom closure flap 29*a*, which would be reduced in length as the width of partial end wall liner flap 32*a* increased, may become funtionally inadequate.

Assembly of the container 12 from the blank 11 involves a relatively straightforward series of folds. Generally, the container can be assembled by hand or on container making equipment of standard design with a few modifications to provide for the folding of the additional container elements that include the side wall liner flaps 25 and 26 and the partial end wall liner flaps 32*a* and 32*b*. The first step in the folding sequence is shown in FIG. 2 with arrows A and B. The side wall liners 25 and 26 are folded 180° relative to and into face-to-face contact with side walls 21 and 23, along score lines 48 and 54, respectively.

Figure 3:
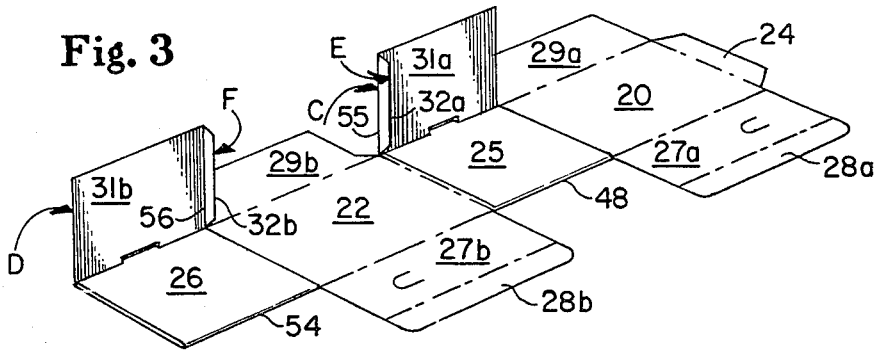
FIG. 3 is a perspective view of the blank of FIG. 1 with the side wall bottom closure flaps folded 90° to a vertical position and the partial inner end wall liner flaps folded at 90°.

Next, as shown in FIG. 3 with arrows C and D, the bottom closure flaps 31*a* and 31*b* are folded 90° relative to side walls 21 and 23, along fold lines 47 and 53, respectively. Once the bottom closure flaps 31*a* and 31*b* are in place the side wall liner 25 and 26 are locked in place by having locking tabs 41*a* and 42*a* fit into the mating die cuts 41*b* and 42*b*, respectively. The locking tabs are shown for illustration only and other means, e.g. adhesives, can be used for securing the side wall liner flaps 25 and 26 into face-to-face contact with side walls 21 and 23, respectively. Also shown in FIG. 3, with arrows E and F, the partial end wall liner flaps 32*a* and 32*b* are folded 90° about score lines 55 and 56, respectively.

In FIG. 4, arrow G indicates the folding of the side wall 21, 90° about score line 49 and arrow H indicates the folding of the side wall 23, 90° about score line 52. End wall 20 is then folded 90° relative to the side wall 21, shown in FIG. 5 with arrow I, and the glue flap 24 is folded to overlap and adhere to the outer surface of side wall 23.

The final folding is shown in FIG. 6, with arrows J and K, in which bottom closure flaps 29*a* and 29*b* are folded 90° relative to the associated end walls along score lines 44 and 50, respectively. The closure flanges 28*a* and 28*b* are then folded 90° relative to top closure flaps 27*a* and 27*b* along score lines 57 and 58, respectively, to form a depending partition and the top closure flaps 27*a* and 27*b* are folded 90° about score lines 45 and 51, respectively, as shown by arrows L and M. The completed container 12 is shown in FIG. 7.

The depending partition, formed by closure flanges 28*a* and 28*b*, is useful for product spacing and separation in the erected carton 12 and is particularly adapted to containers for shipping bottles and the like. However, it should be obvious to one skilled in the art that the closure flanges 28*a* and 28*b* could be omitted if desired. For example, a partition is generally unsuitable for shipping containers containing smaller boxes, e.g. cereal boxes. In such a situation the top closure flaps 27*a* and 27*b* of the container can be sealed by taping or other similar closure means.

The container 12 also includes a means for identifying the appropriate area for retailers to cut to open the sealed containers 12 for access to the contents. Since the cut case protection is provided along only three walls in this container embodiment such means is needed to designate the appropriate walls to cut. Innumerable methods could be suggested and one of ordinary skill in the art will appreciate that the method chosen can be useful for purposes of adapting the carton to other uses, e.g. stacking, display or the like after cutting. FIG. 7 illustrates one method for designating the appropriate walls to cut by having a line N printed on the outer surface of the cut walls and along score line 45. In the illustrated embodiment the partial end wall liner, formed by the partial end wall liner flaps 32*a* and 32*b*, provides cut-case protection along the lower part of end wall 22 and side wall liner flaps 25 and 26 provide cut-case protection along side walls 21 and 23, respectively. The container 12 is opened by cutting along line N horizontally across end wall 22 and score line 45 and diagonally along side walls 21 and 23. The upper section of the container 12 above line N, including top closure flaps 27*a* and 27*b*, side wall liner flaps 25 and 26 and the upper portions of end wall 22 and side walls 21 and 23, is then removed and discarded.

Figure 8:
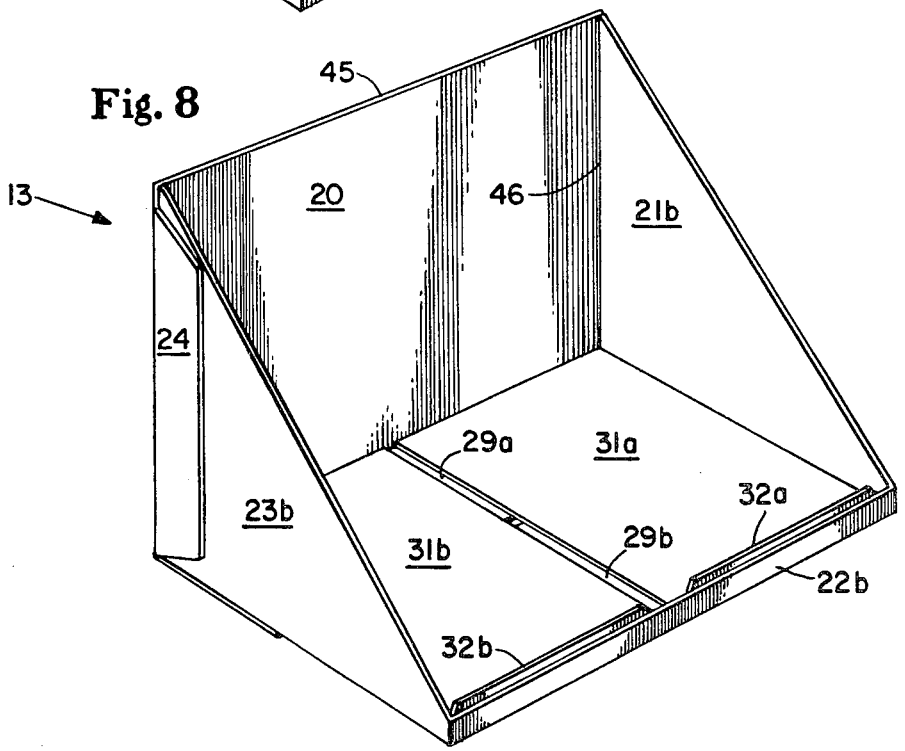
FIG. 8 is a perspective view of the container shown in FIG. 7 after having the upper section of the container cut away.

Once the container is cut away, as shown in FIG. 8, the remainder, designated 13, of the container 12 can be used for display purposes or it can be stacked with other remainders 13 to provide a ready-made shelf. The relatively short partial end wall liner formed by flaps 32*a* and 32*b* is ideally suited to providing a minimum end wall remainder 22*b* and to thereby effectively display the articles contained in the container. Further adaptations of the container for display, stacking, reuse or the like can be accomplished by appropriate modifications to the container by one of ordinary skill in the art without departing from the scope of the present invention.

Figure 9:
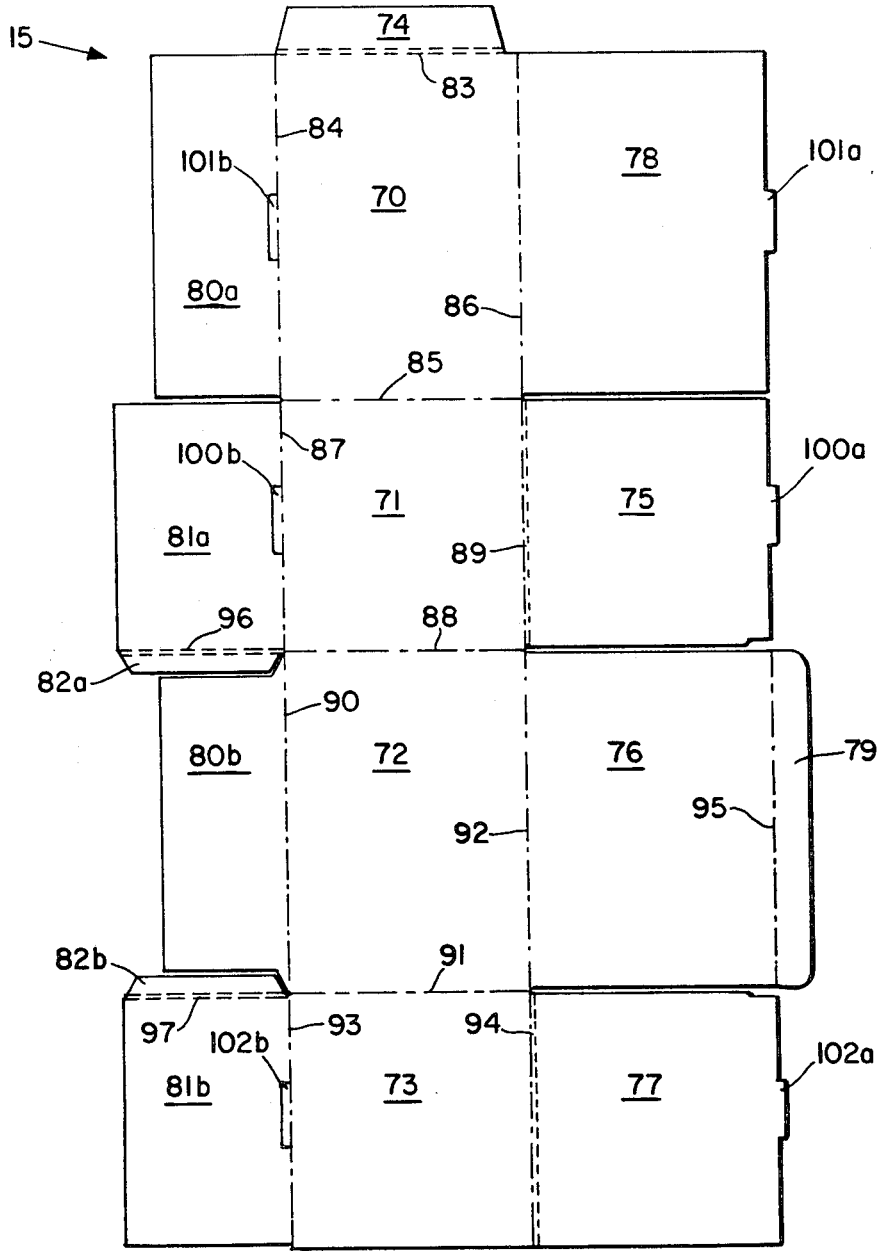
FIG. 9 is a plan view of an alternative container blank illustrative of the present invention.

The present invention can be adapted to a container in which only a single top closure flap 76 is employed, as shown in FIG. 9. The blank 15, shown in FIG. 9, comprises a pair of end walls 70 and 72 and a pair of side walls 71 and 73 in alternating side by side relation and a glue flap 74. Parallel transverse score lines 83, 85, 88 and 91 separate the various walls and glue flap.

Each of the end walls 70 and 72 and the side walls 71 and 73 include left and right laterally extending closure flaps. End wall 70 includes end wall liner flap 78 hingedly connected at score line 86 and adapted to fold into face-to-face contact with end wall 70 and bottom closure flap 80*a* hingedly connected at score line 84. End wall 72 includes top closure flap 76 hingedly connected at score line 92 and bottom closure flap 80*b* hingedly connected at score line 90 and adapted, in conjunction with bottom closure flap 80*a*, to form the outer coplanar sections of the bottom closure. Top closure flap 76 further includes closure flange 79 hingedly connected at score line 95 and adapted to folded onto and be adhered to end wall 70. The side walls 71 and 73 include side wall liner flaps 75 and 77 hingedly connected at score lines 89 and 94, respectively, and adapted to fold into face-to-face contact with the associated side walls and bottom closure flaps 81*a* and 81*b* hingedly connected at score lines 87 and 93, respectively, and adapted to form the inner coplanar sections of the bottom closure. Each of the bottom closure flaps 81*a* and 81*b* further include a partial end wall liner flap 82*a* or 82*b* hingedly connected at score lines 96 and 97, respectively, which are perpendicular to score lines 87 and 93 and adjacent to an end thereof. The partial end wall liner flaps 82*a* and 82*b* are adapted to form coplanar portions of partial end wall liner for end wall 72.

Each of the wall liner flaps shown in FIG. 9, end wall liner flap 78, and side wall liner flaps 75 and 77 is substantially the same dimension as its associated end wall or side wall so that it will substantially cover the end wall or side wall when the container 17 is erected. The wall liner flaps 78, 75 and 77 also include locking tabs 101*a*, 100*a*, and 102*a*, respectively, which are adapted to insert into mating die cut sections 101*b*, 100*b*, 102*b*. The locking tabs are shown for illustration purposes only since other means such as adhesives could also be used.

Figure 1:
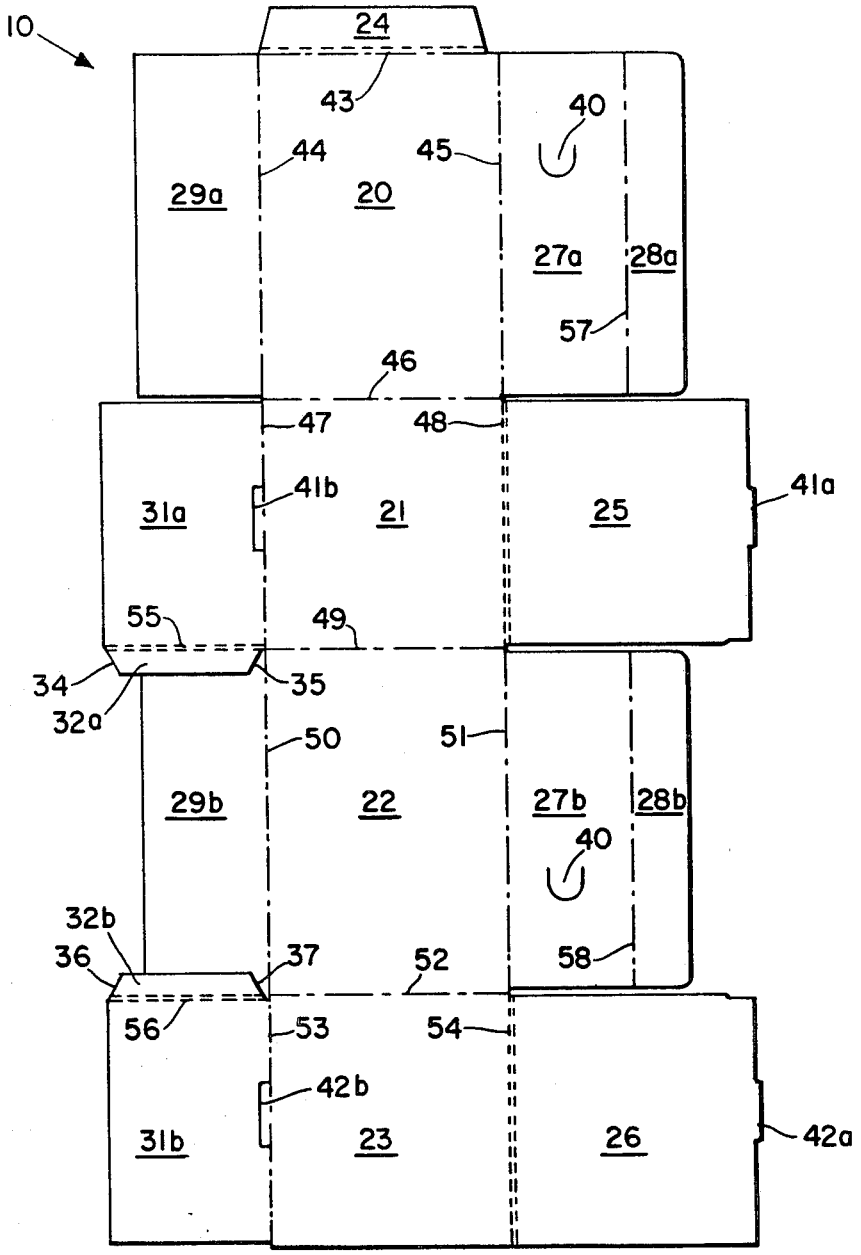
FIG. 1 is a plan view of a container blank illustrative of the present invention.
Figure 2:
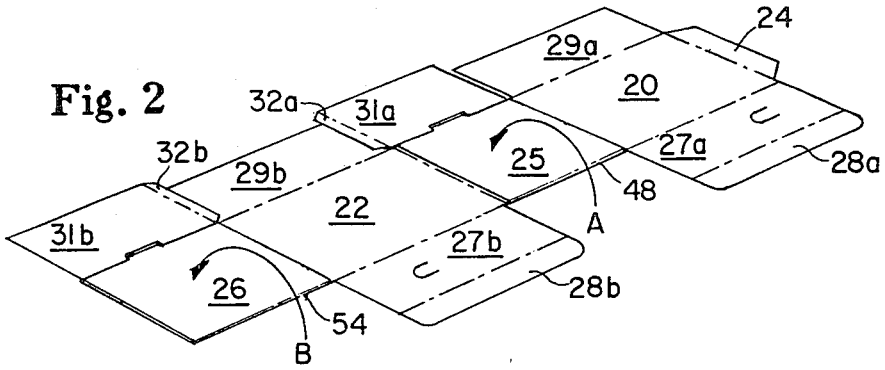
FIG. 2 is a perspective view of the blank of FIG. 1 showing the first step in the folding sequence for erecting the container.

The partial end wall liner flaps 82*a* and 82*b* are identical in design to the partial end wall liner flaps 32*a* and 32*b* as shown in FIG. 1. Therefore, in order to provide as nearly continuous a partial end wall liner for end wall 72 as possible and yet still enable the container 17 to be erected from the blank 15 with ease, bottom closure flaps 81*a* and 81*b* are sized in width (from the distal end to the hinge line with the associated side wall) to be only slightly less, approximately $\frac{1}{8}''$ to $\frac{1}{4}''$, than half the length of either of the end walls 70 and 72. Therefore the partial end wall liner flaps 82*a* and 82*b* are also slightly less, approximately $\frac{1}{8}''$ to $\frac{1}{4}''$, in length than half the length of end wall 72. In a preferred embodiment the partial end wall liner flaps 82*a* and 82*b* also include chamfered edges on both ends to further facilitate erecting the container 17. The partial end wall liner flaps 82*a* and 82*b* can vary in width (from the distal end to the hinge line with the associated bottom closure flap) depending on the protection required but, in the blank as shown in FIG. 9, the width should remain within the range of $\frac{1}{2}''$ and $1\frac{1}{2}''$. Otherwise, bottom closure flap 80*b*, which is reduced in length as the width of partial end wall liner flaps 82*a* and 82*b* increase, may become functionally inadequate.

Figure 10:
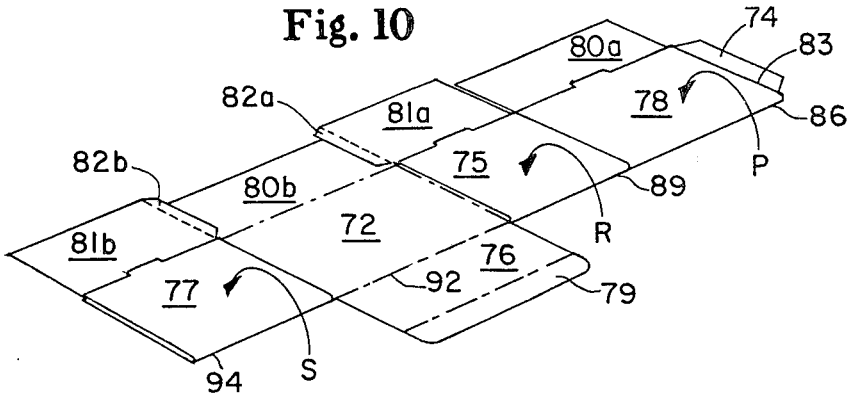
FIG. 10 is a perspective view of the blank of FIG. 9 showing the first step in the folding sequence for erecting the carton.
Figure 11:
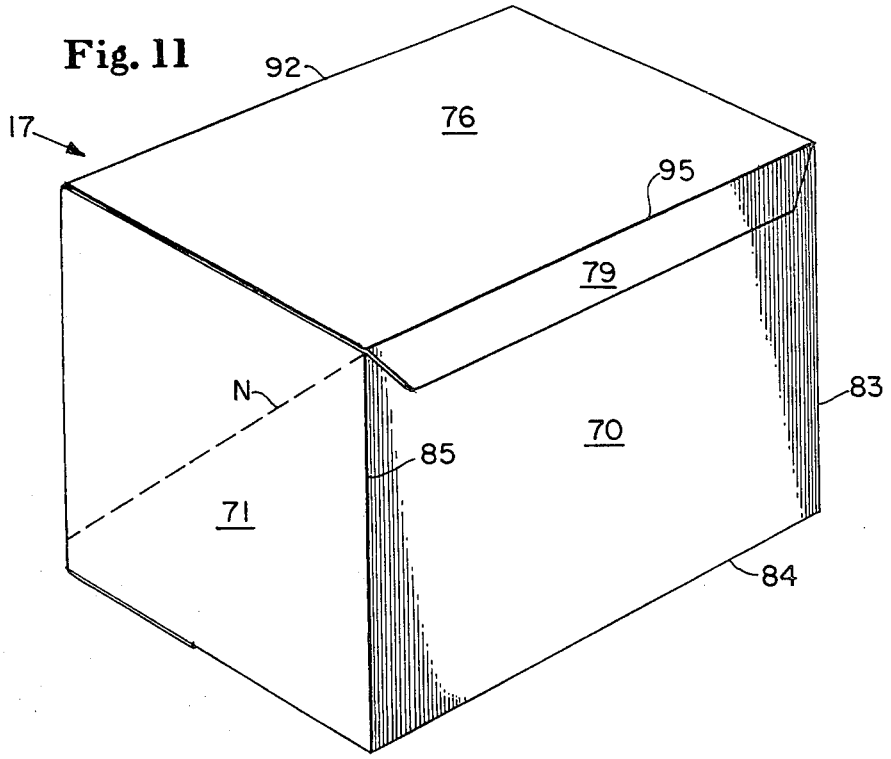
FIG. 11 is a perspective view of the container erected from the blank of FIG. 9.

Assembly of container 17 from blank 15 involves a series of folds similar to that required to assemble container 12 from blank 11, described above. The initial step in the folding sequence is shown in FIG. 10. The end wall liner flap 78, and side wall liner flaps 75 and 77 have each been folded 180° relative to and into face-to-face contact with end wall 70 and side walls 71 and 73 along score lines 86, 89 and 94, respectively, as shown by arrows P, R and S, respectively.

Next, bottom closure flaps 81*a* and 81*b* are folded about score lines 87 and 93, 90° relative to the side walls 71 and 73, respectively. The side wall liner flaps 75 and 77 are now locked in place by having tabs 100*a* and 102*a* fit into the mating die cuts 100*a* and 102*a*, respectively. The partial end wall liner flaps 82*a* and 82*b* are then folded about score lines 96 and 97, respectively.

The next step is to fold side walls 71 and 73, 90° about score line 88 and 91, respectively. The end wall 70 can then be folded 90° about score line 85 and the glue flap 74 can be folded about score line 83 to overlap and adhere to the outer surface of side wall 73. The bottom of the container 17 is completed by folding bottom closure flaps 80*a* and 80*b*, 90° relative to the associated end walls 70 and 72 about score lines 84 and 90. The top of the container 17 is completed by folding top closure flap 76, 90° about score line 92 and folding closure flange 79, 90° about score line 95 to fold onto and be adhered to the outer surface of end wall 70 or to tuck inside and be in face-to-face contact with the inner surface of end wall 70 as a partial end wall liner.

Figure 12:
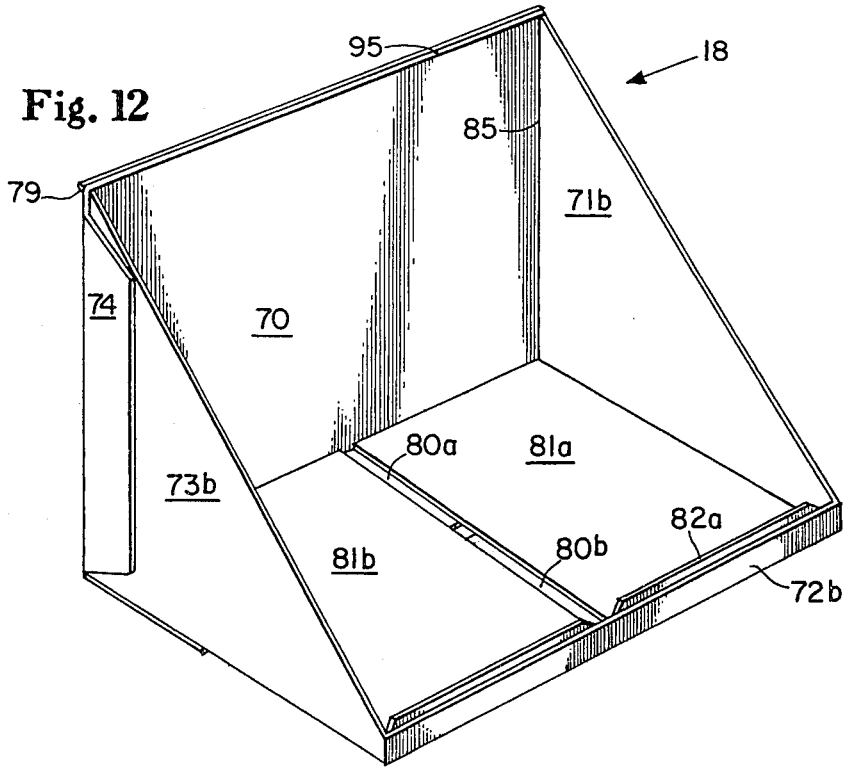
FIG. 12 is a perspective view of the container erected from the blank of FIG. 9 after having the upper section of the container cut away.

The completed container 17 includes an appropriate means for identifying the area for retailers to cut open the sealed container 17 for access to the contents. Since the cut case protection in this embodiment is provided along three entire walls and partially along a fourth wall, there are considerably more alternatives for cutting than in carton 12, FIG. 7. As previously shown in FIG. 7, one method of designating the appropriate cutting areas is by a printed line N. Again, as with container 12, container 17 can be cut away as shown in FIG. 12. The upper section of container 17 above line N, including top closure flap 76, side wall liner flaps 75 and 77, end wall liner flap 78 and the upper portions of end wall 70 and side walls 71 and 73, is then removed and discarded. The remainder of container 17, designated 18 and shown in FIG. 12, can be used for display purposes or it can be stacked with other container remainders 18 to provide a ready-made shelf.

Figure 13:
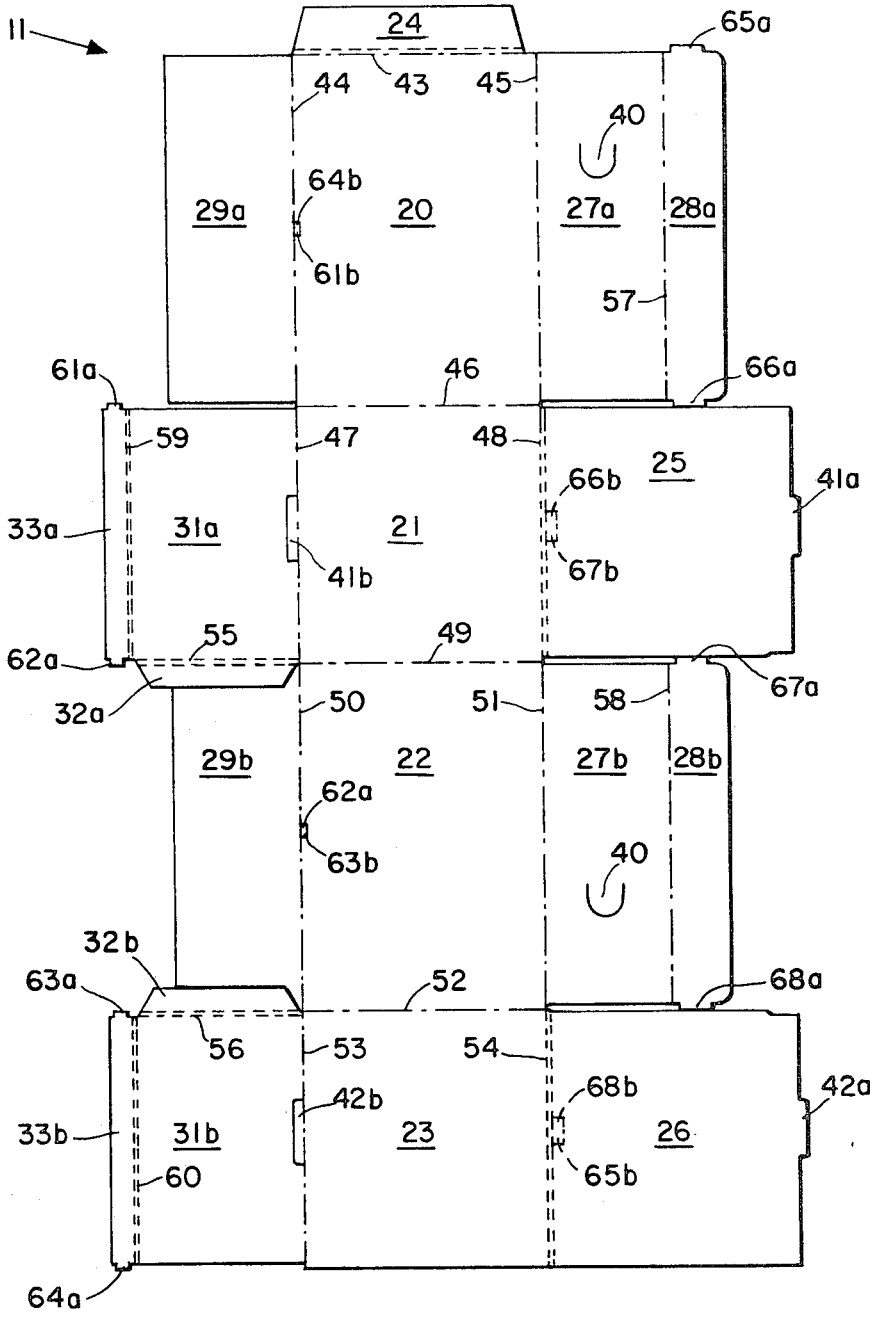
FIG. 13 is a plan view of a blank similar to FIG. 1 that provides for integral bottom partitions in the erected containers.
Figure 14:
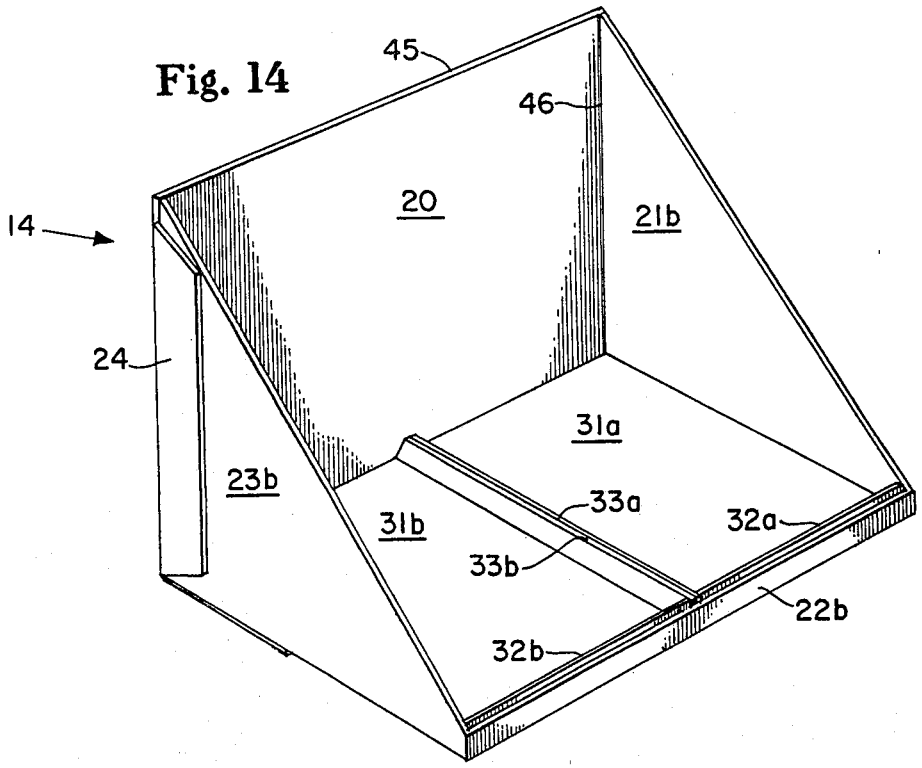
FIG. 14 is a perspective view of the container erected from the blank of FIG. 13 after having the upper section of the container cut away.

Both container 12 formed from blank 10 and container 17 formed from blank 15 can be modified to include a number of useful, additional structural elements such as partitions. For example, a modified form of blank 10 is shown in FIG. 13 as blank 11. Blank 11 includes all of the elements shown in FIG. 1 plus the addition of partition flaps 33*a* and 33*b* hingedly connected to bottom closure flaps 31*a* and 31*b*, respectively. The partition flaps 33*a* and 33*b* fold 90° about score lines 59 and 60 to a vertical position and are adapted to form partitions and thereby divide the interior of the container into several areas and to separate the articles contained therein. The container formed from this blank, shown with the upper section cut away in FIG. 14 and designated 14, will include a single partition, formed from partition flaps 33*a* and 33*b*, that divides the container into two separate areas. The width of the partition flaps 33*a* and 33*b* (from the distal end to the hinge line with the associated bottom closure flap) can be varied as desired but it should be recognized by one of ordinary skill in the art that the longer the width of the partition flaps 33*a* and 33*b* the greater will be the resulting use of board.

Partition flaps 33*a* and 33*b* can be employed in conjunction with the closure flanges 28*a* and 28*b* to further separate and support the articles to be shipped. Both the partition flaps 33*a* and 33*b* and the closure flanges 28*a* and 28*b* can be designed to include locking tabs in order to secure the partitions in a vertical position. In FIG. 13, partition flaps 33*a* and 33*b* are shown to include locking tabs 61*a*, 62*a* and 63*a*, 64*a* respectively, which mate with die cut sections 61*b*, 62*b*, 63*b*, and 64*b*, respectively, in end walls 20 and 22. Closure flanges 28*a* and 28*b* are shown to include locking tabs 65*a*, 66*a*, and 67*a*, respectively, to mate with die cut sections 65*b*, 66*b*, 67*b*, and 68*b*, respectively, in side wall liner flaps 25 and 26. Alternatively, an adhesive could be employed instead of the locking tabs to secure the partitions in a vertical position.

Having shown and described the preferred embodiment of the present invention, further adaptations of the container can be accomplished by appropriate modifications to the blank or the container by one of ordinary skill in the art without departing from the scope of the present invention. Accordingly, the scope of the present invention should be considered in terms of the following claims and is understood not to be limited to the details of structure and operation shown and described in the specification and drawings.

I claim:

1. A corrugated container formed from a unitary blank and having economical cut-case protection, said container comprising:

(a) a pair of end walls and a pair of side walls integrally connected in alternating side-by-side relation;

(b) said end walls each having an integrally connected bottom closure flap, which flaps together form an outer coplanar section of a bottom closure;

(c) at least one of said end walls having an integrally connected top closure flap;

(d) said side walls each having integrally connected at its top end a side wall liner flap of substantially the same dimension as said side walls folded inwardly into face-to-face contact with said side walls;

(e) said side walls each having a bottom closure flap integrally connected by a first score line and which flaps together form an inner coplanar section of said bottom closure;

(f) said bottom closure flaps of said side walls each having a partial end wall liner flap integrally connected therewith along a second score line perpendicular to the associated said first score line and adjacent an end thereof;

(g) said partial end wall liner flaps being located at the same end of said container and folded at an angle of about 90° with said bottom closure flaps of said side walls, forming coplanar portions of a partial end wall liner across the lower part of one of said end walls; and (h) printed matter on said container indicating that the container is opened by cutting across said lower part of one of said end walls, adjacent the partial end wall liner, and across the side walls.

2. The container of claim 1 in which said top closure flap is integrally connected to said end wall by a first score line and has a closure flange integrally connected by a second score line parallel to said first score line and spaced therefrom by a distance approximating the length of said side walls; said closure flange being folded inwardly to form a partial end wall liner at the top edge of the other said end wall.

3. The container of claim 1 or 2 in which the other said end wall is provided with an integrally connected end wall liner flap of substantially the same dimension as said end wall; said end wall liner flap being folded inwardly into face-to-face contact with said end wall.

4. The container of claim 1 in which each of said end walls has an integrally connected top closure flap, which flaps are adapted to form coplanar sections of a top closure.

5. The container of claim 4 in which each of said top closure flaps are integrally connected to said end walls by a first score line and have a closure flange integrally connected by a second score line parallel to said first score line and spaced therefrom by a distance approximating one half of the length of said side walls; said closure flanges being folded inwardly into face-to-face contact with each other.

6. The container of claim 1 or 4 in which the distal end of each of said bottom closure flaps of said side walls carries a partition flap integrally connected by a third score line parallel to and spaced from the associated said first score line; said partition flaps being adapted to fold upwardly into face-to-face contact.

* * * * *